US006367804B1

(12) United States Patent
Watts

(10) Patent No.: US 6,367,804 B1
(45) Date of Patent: Apr. 9, 2002

(54) VARIABLE BORE RAM PACKER FOR TAPERED TUBULAR MEMBERS IN A RAM TYPE BLOWOUT PREVENTER

(75) Inventor: Gerald D. Watts, Hempstead, TX (US)

(73) Assignee: Cooper Cameron Corporation, Houston, TX (US)

( * ) Notice: Subject to any disclaimer, the term of this patent is extended or adjusted under 35 U.S.C. 154(b) by 0 days.

(21) Appl. No.: 09/550,403

(22) Filed: Apr. 14, 2000

(51) Int. Cl.[7] ..... F16J 15/00

(52) U.S. Cl. ..... 277/325; 277/619; 251/1.2; 156/85.4

(58) Field of Search ..... 277/323, 324, 277/325, 326; 251/1.2, 325; 175/195; 166/386, 85.4

(56) References Cited

U.S. PATENT DOCUMENTS

| | | | | | |
|---|---|---|---|---|---|
| 2,846,178 | A | | 8/1958 | Minor | 251/2 |
| 3,897,038 | A | | 7/1975 | Le Rouax | 251/1 |
| 3,917,293 | A | | 11/1975 | Lewis et al. | 277/114 |
| 3,994,472 | A | * | 11/1976 | Williams | 277/325 |
| 4,099,699 | A | | 7/1978 | Allen | 251/1 B |
| 4,229,012 | A | | 10/1980 | Williams, III | 277/127 |
| 4,332,317 | A | | 6/1982 | Bähre et al. | 198/734 |
| 4,444,404 | A | | 4/1984 | Parks, Jr. | 277/235 R |
| 4,452,421 | A | | 6/1984 | Huey et al. | 251/1 B |
| 4,458,876 | A | | 7/1984 | Schaeper et al. | 251/1 B |
| 4,550,895 | A | | 11/1985 | Shaffer | 251/1.3 |
| 5,294,088 | A | * | 3/1994 | McWhorter et al. | 277/325 |
| 5,603,481 | A | * | 2/1997 | Parker et al. | 277/324 |
| 5,851,013 | A | * | 12/1998 | Simons | 277/325 |

* cited by examiner

*Primary Examiner*—Anthony Knight
*Assistant Examiner*—Enoch Peavey
(74) *Attorney, Agent, or Firm*—Jackie Lee Duke

(57) ABSTRACT

A variable bore ram packer designed for use in a standard ram-type blowout preventer used in oil and gas drilling operations is disclosed. The variable bore ram packer is molded of an elastomeric material having a central semi-circular opening sized to fit closely about a tubular member. The packer member includes a plurality of pillar inserts molded within the elastomeric material around the central semi-circular opening. The packer member and the plurality of pillar inserts are molded into a unitary structure allowing the plurality of pillar inserts to move and seat against different diameter tubular members to prevent extrusion of the elastomeric material between the pillar inserts and the tubular member. The pillar inserts include a top plate, a bottom plate and a spacer pin positioned therebetween. The top and bottom plates are a substantially triangular shape and in the preferred embodiment are free to rotate relative to the spacer pin independently of one another. The independent movement of the top and bottom plates allows the top and bottom plates to move and seat against different diameters.

20 Claims, 8 Drawing Sheets

VARIABLE BORE RAM PACKER FOR TAPERED TUBULAR MEMBERS IN A RAM TYPE BLOWOUT PREVENTER

BACKGROUND OF THE INVENTION

1. Field of the Invention

This invention relates to an improved variable bore ram packer for a ram-type blowout preventer used in oil and gas drilling operations. The improved ram packer can seal on the tapered shoulder of a tool joint of a section of drill pipe as well as a range of straight pipe diameters. Ram-type blowout preventers are part of a pressure control system used in oil and gas drilling operations to control unexpected well bore pressure spikes or "kicks" as they are commonly referred to in the industry.

The blowout preventer has a body with a vertical bore and a pair of laterally disposed opposing bonnet assemblies. Each bonnet assembly includes a piston which is laterally moveable within the bonnet assembly by pressurized hydraulic fluid. Replaceable sealing elements called "packers" are mounted within rams attached to the ends of the pistons which extend into the blowout preventer bore. When these pistons are moved to a closed position, commonly referred to as "closing the blowout preventer" or "closing the rams", the vertical bore of the blowout preventer is sealed and the "kick" is contained. These "packers" are available in a variety of configurations designed to seal the blowout preventer bore when the opposing rams and pistons are moved to their closed position.

One type of ram with packer has ends designed to seal around pipe of a specific size in the blowout preventer bore when the blowout preventer is "closed." Other rams with packers are configured to seal around a range of pipe sizes. It is the type designed to seal around a range of pipe sizes, called variable bore ram packers to which the present invention is directed. The ram packers form a pressure tight seal during a kick until the well bore pressure can be controlled. The well bore pressure can reach several thousand pounds per square inch during a "kick." Each ram packer has a semicircular opening in its front face to form a seal around 180° of the outer periphery of the pipe. When the rams are closed as described above, the opposing ram packers meet and seal the entire 360° periphery of the pipe. The novel variable bore ram packer of the present invention also has the ability to seal on the tapered tool joint of a section of drill pipe. This is especially important because when a kick occurs the tapered diameter tool joint may be in the bore of the blowout preventer rather than the straight section of drill pipe. Current designs are not able to effectively seal against such a tapered diameter.

Additionally, the variable bore ram packer is required to seal against the drill pipe during a "stripping" operation. During a stripping operation, the drill pipe is pulled from the well bore with the blowout preventer closed against the drill pipe. This results in enormous wear and tear on the ram packer, particularly the elastomeric sealing element. In an effort to minimize the tearing and loss of mass of the elastomeric sealing element, numerous modifications and additions to the ram packer and particularly the elastomeric sealing element in ram-type blowout preventers have been used. Problems associated with these modifications and additions to the variable bore ram packers include excessive loss of mass of the elastomeric seal element, expensive to manufacture and maintain and requiring special oversized blowout preventer rams to accept the variable bore ram packers. The variable bore ram packer of the current invention offers a substantial improvement by offering a variable bore ram packer which accommodates a range of pipe sizes, that can seal on a tapered tapered section of pipe, i.e., a tool joint, and reduces the forces needed to operate the variable bore packer.

2. Description of Related Art

The use of metal inserts in a conical-type blowout preventer is disclosed in U.S. Pat. No. 2,846,178 to B. S. Minor.

U.S. Pat. No. 3,897,038 to R. K. Le Rouax shows a ram type blowout preventer using metal inserts as an anti-extrusion means.

The use of metal inserts in an annular blowout preventer to control the stress level in the elastomeric packer unit is shown in U.S. Pat. No. 3,917,293 to G. E. Lewis et al.

U.S. Pat. No. 4,099,699 to H. Allen shows the use of irising metal inserts in an annular blowout preventer.

Another example of metal inserts in a variable bore blowout preventer in disclosed in U.S. Pat. No. 4,229,012 to B. C. Williams, III.

U.S. Pat. No. 4,444,404 to G. C. Parks, Jr. shows an example of a variable bore ram packer with interlocking anti-extrusion metal inserts.

Another example of a variable bore ram packer with interlocking anti-extrusion metal inserts is disclosed in U.S. Pat. No. 4,458,876 to G. R. Schaeper et al.

U.S. Pat. No. 4,550,895 to D. U. Shaffer shows an early version of a variable bore ram packer. This apparatus utilizes a plurality of annular segments embedded in the elastomeric rubber to aid in effectuating a seal.

SUMMARY OF THE INVENTION

The variable bore ram packer of the present invention is designed for use in a standard ram-type blowout preventer used in oil and gas drilling operations. The blowout preventer has a body with an axial bore, a pair of opposing bonnet assemblies and a pair of opposing rams laterally moveable within the bonnet assemblies by a pressurized fluid source to control flow of well fluids through the blowout preventer body axial bore. The variable bore ram packer includes a ram body, a top seal and a packer member. The packer member is molded of an elastomeric material having a central semi-circular .opening sized to fit closely about a tubular member. The packer member includes a plurality of pillar inserts molded within the elastomeric material around the central semi-circular opening. The packer member and the plurality of pillar inserts are molded into a unitary structure allowing the plurality of pillar inserts to move and seat against different diameter tubular members to prevent extrusion of the elastomeric material between the pillar inserts and the tubular member.

The pillar inserts include a top plate, a bottom plate and a spacer pin positioned therebetween. The top and bottom plates are a substantially triangular shape and in the preferred embodiment are free to rotate relative to the spacer pin independently of one another. Each of the top and bottom plates includes a guide lip and a guide shoulder. The guide lips and guide shoulders of adjacent top plates and the guide lips and guide shoulders of adjacent bottom plates coact to provide an irising motion to the top and bottom plates as the top and bottom plates move and seat against different diameter tubular members. The independent movement of the top and bottom plates allows the top and bottom plates to move and seat against different diameters.

A principal object of the present invention is to provide a variable bore ram packer that allows sealing over a wide range of tubular member diameters that minimizes the force required to operate the variable bore ram packer.

Another object of the present invention is to provide a variable bore ram packer that will reliably maintain a seal against different sized tubular members while minimizing damage to the elastomeric sealing element of the packer.

A final object of the present invention is to provide a variable bore ram packer that can seat and seal around a tapered diameter tubular member such as a drill pipe tool joint.

These with other objects and advantages of the present invention are pointed out with specificness in the claims annexed hereto and form a part of this disclosure. A full and complete understanding of the invention may be had by reference to the accompanying drawings and description of the preferred embodiments.

BRIEF DESCRIPTION OF THE DRAWINGS

These and other objects and advantages of the present invention are set forth below and further ade clear by reference to the drawings, wherein.

DESCRIPTION OF THE PREFERRED EMBODIMENT

Figure 1:
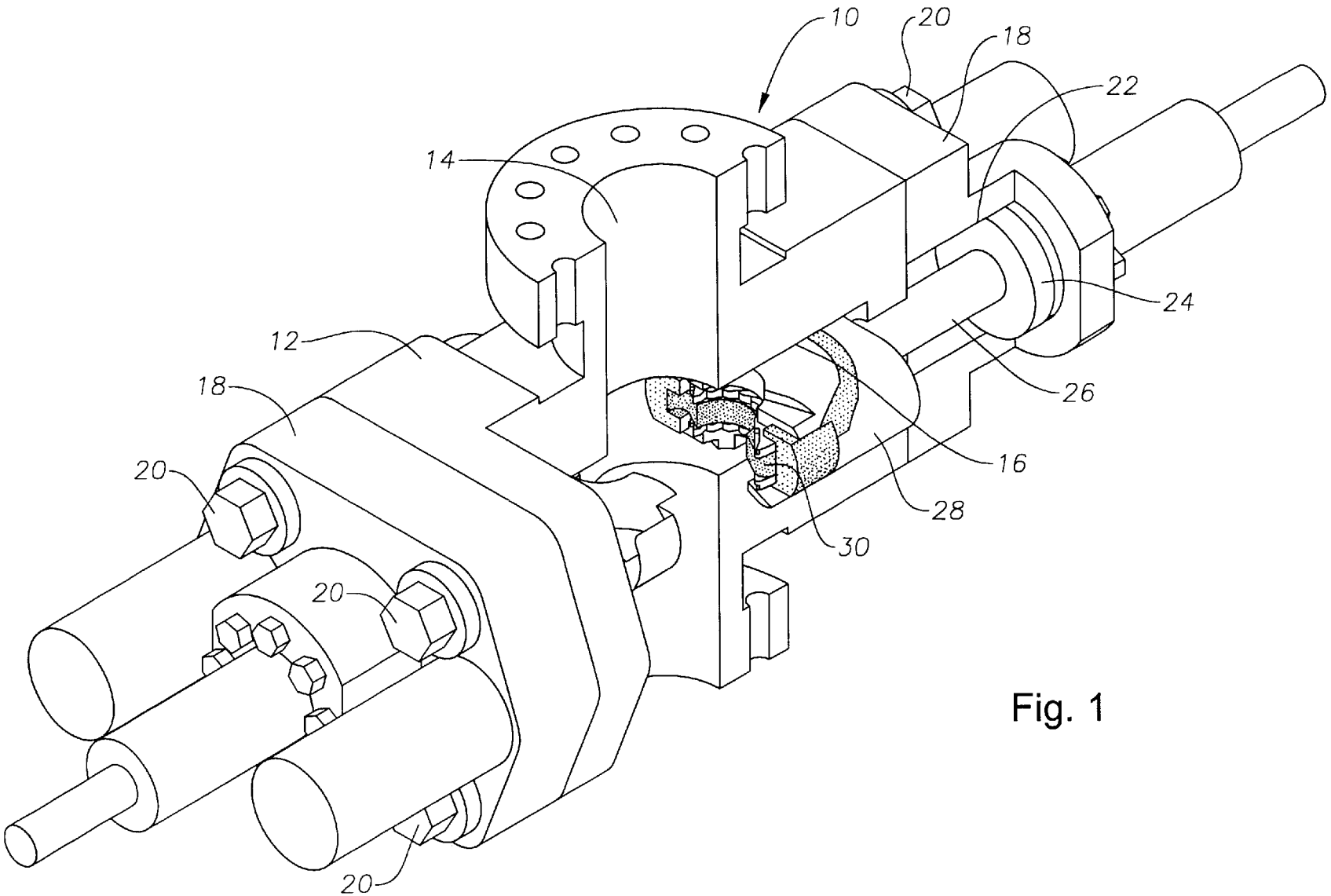
FIG. 1 is a perspective view with a cutaway section of the variable bore ram packer of the present invention installed in a typical ram-type blowout preventer used in oil and gas drilling operations.

With reference to the drawings, and particularly to FIG. 1, an isometric view of a ram type blowout preventer 10 used in oil and gas drilling operations is shown. The ram type blowout preventer 10 includes a body or housing 12 with a vertical bore 14 and laterally disposed ram guideways 16. Bonnet assemblies 18 are mounted to the body 12 with suitable securing means such as studs or bolts 20 and aligned with laterally disposed guideways 16. Each bonnet assembly 18 includes an actuation means 22, including a piston 24 and connecting rod 26. While only one guideway 16 and actuation means 22 is shown, it is understood by those of ordinary skill in the art that there is a pair of opposed guideways 16 and actuation means 22. Each connecting rod 26 is connected to a ram 28 which includes the variable bore ram packer 30 of the present invention. Actuation means 22 allows ram 28 and variable bore ram packer 30 to be reciprocated within guideways 16 or "opening and closing the rams" as it is referred to in the industry.

Figure 2:
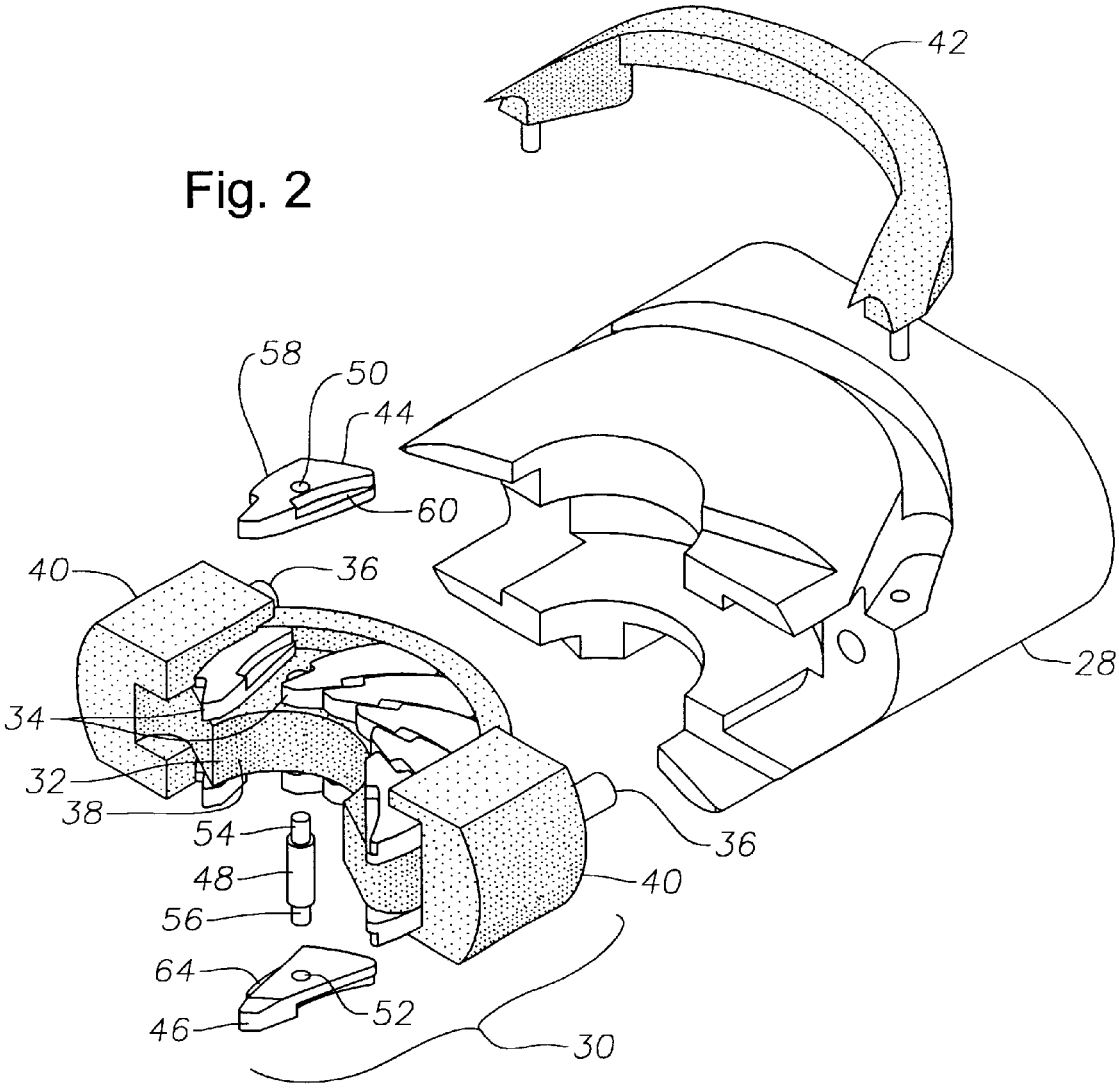
FIG. 2 is a perspective view of the variable bore ram packer of the present invention in an exploded view.

Variable bore ram packer 30 is shown in an exploded view in FIG. 2 to aid in understanding the relationship between the parts. Variable bore ram packer 30 includes packer member 32, pillar inserts 34 and packer pins 36 molded into one unitary structure of an elastomeric material with pillar inserts 34 arranged around a central semi-circular opening 38 sized to fit closely about a tubular member. Packer pins 36 are molded into variable bore ram packer 30 for connecting variable bore ram packer 30 to ram 28. Packer member 32 is molded to form side packers 40 on its lateral edges. Ram 28 includes top seal 42 on its upper face. Top seal 42 and side packers 40 combine to seal ram 28 in guideways 16 of ram type blowout preventer 10 in a manner well known to those of ordinary skill in the art. When rams 28 are closed around a tubular member disposed in bore 14 of ram type blowout preventer 10, packer members 32 seal around the tubular member in a manner to be described more fully hereinafter.

Figure 3:
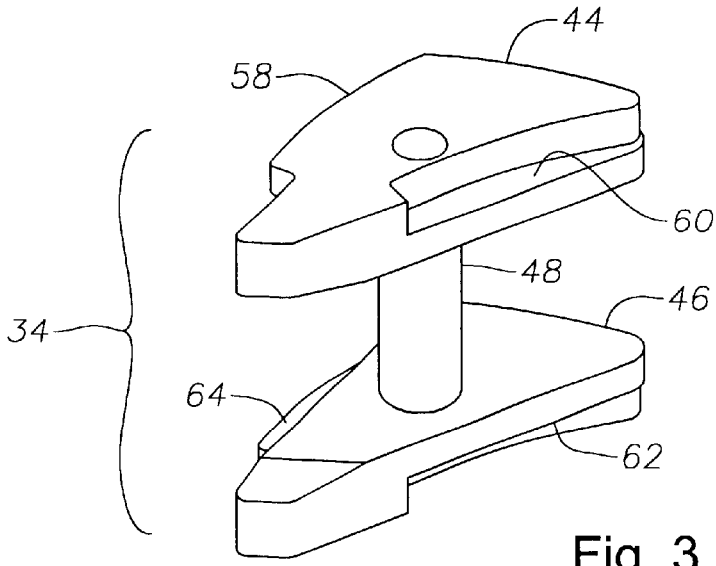
FIG. 3 is a perspective view of the pillar insert for the variable bore ram packer.

As seen in exploded view in FIG. 2 and assembled in FIG. 3, pillar inserts 34 include top plate 44, bottom plate 46 and spacer pin 48. Top plate 44 and bottom plate 46 are substantially triangular in shape with holes 50 and 52 substantially centrally positioned, respectively, to receive spacer pin 48. Spacer pin 48 has reduced diameter end sections 54 and 56 to mate with holes 50 and 52, respectively. As shown in this preferred embodiment, top plate 44 and bottom plate 46 are free to rotate on spacer pin 48 for purposes to be explained more fully hereinafter. Top plate 44 and bottom plate 46 are mirror images of one another and include guide lip 58 and guide shoulder 60 formed on top plate 44 and guide lip 62 and guide shoulder 64 formed on bottom plate 46. Thus, when pillar inserts 34 are molded into packer member 32, guide lips 58 and guide shoulders 60 of adjacent top plates 44 overlap. Similarly, guide lips 62 and guide shoulders 64 of adjacent bottom plates 46 overlap with spacer pins 48 connecting top plates 44 and bottom plates 46. Thus, as seen in FIG. 2, the assemblies of top plates 44 and bottom plates 46 are arranged to form a semi-circular steel arcs similar to that of an "iris" shutter of a camera that acts to prevent extrusion of the elastomeric material of packer member 32 in use.

Figure 4:
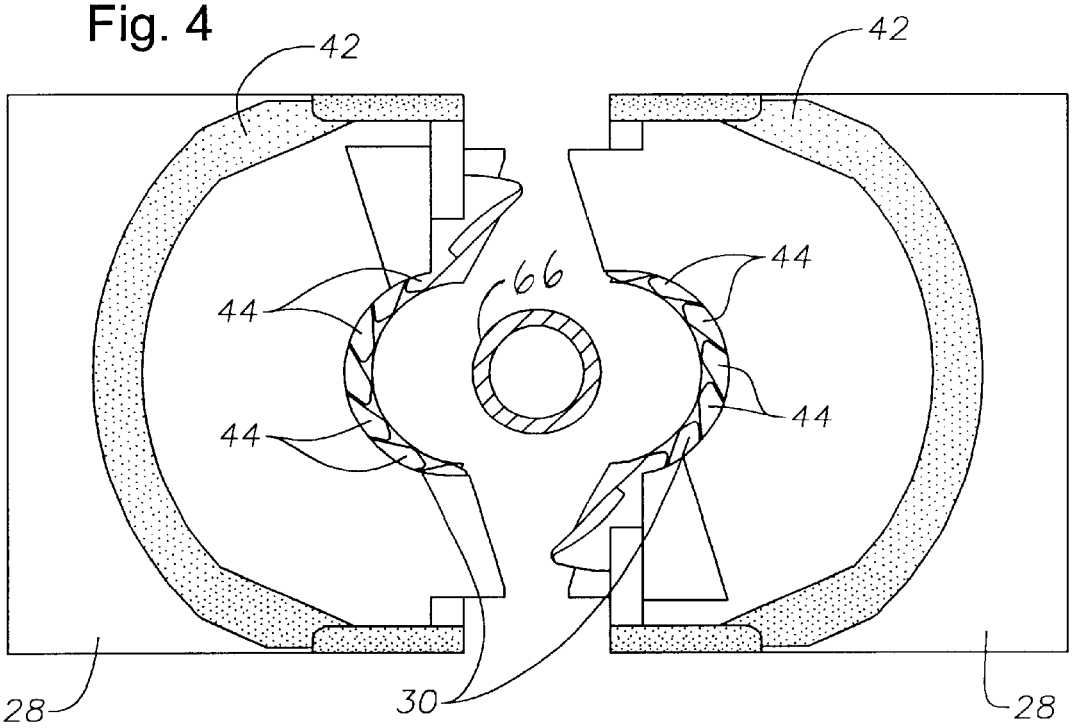
FIG. 4 is a plan view of the variable bore ram packer in its open position.
Figure 5:
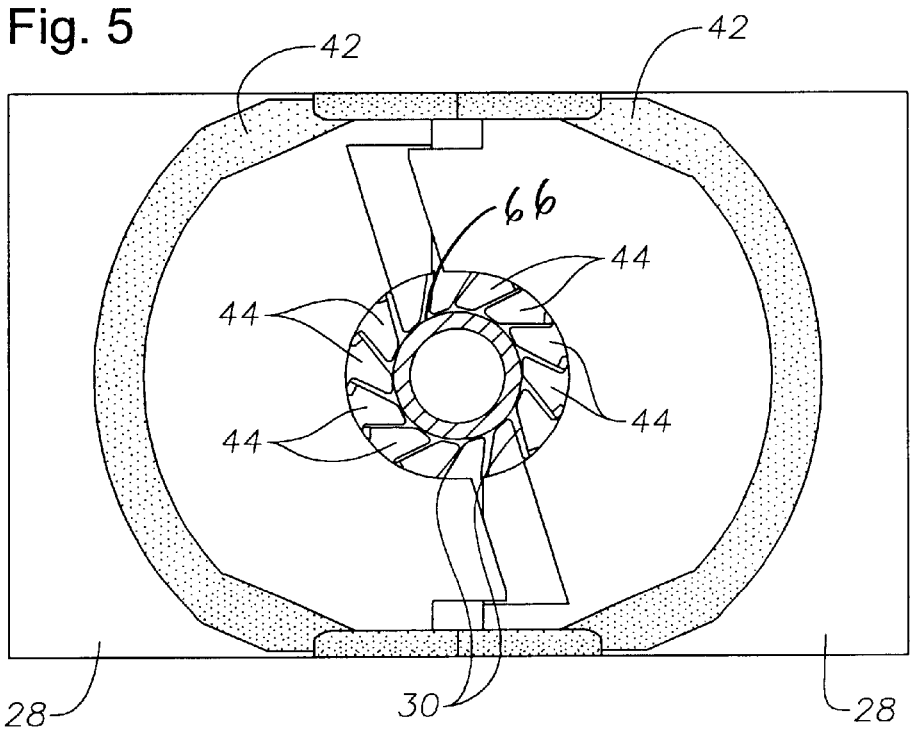
FIG. 5 is a plan view of the variable bore ram packer in its closed position.
Figure 6:
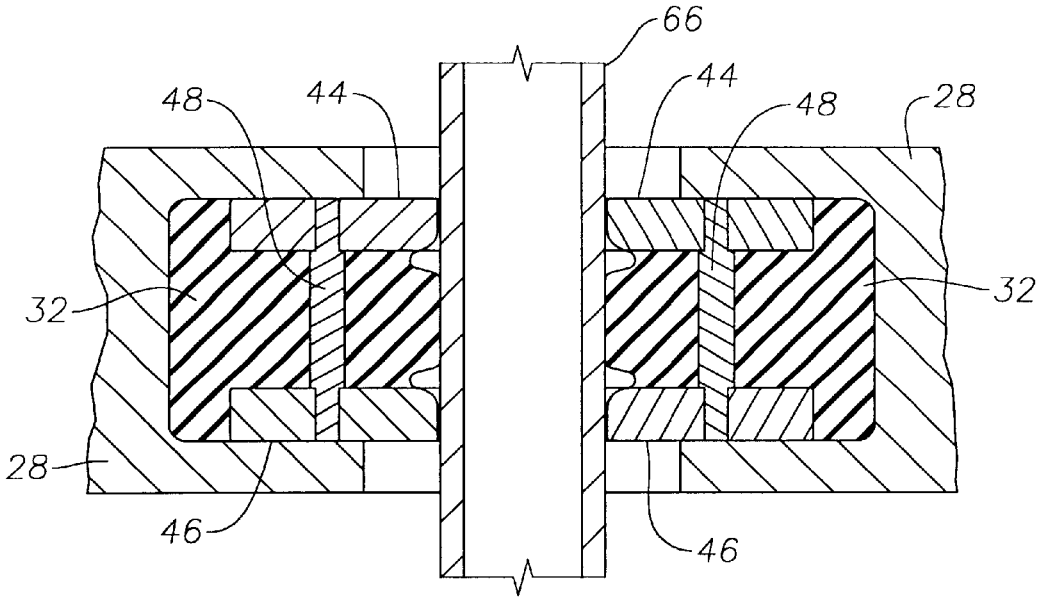
FIG. 6 is a sectional view of the variable bore ram packer of FIG. 5.

The movement and actual irising motion of the top plates 44 and bottom plates 46 as they occur in use are best seen in FIGS. 4 and 5. In FIG. 4, variable bore ram packers 30 are shown in there full open position, prior to being closed, with drill pipe or tubular member 66 is positioned within the bore 14 of ram type blowout preventer 10 with its axis substantially coaxial with that of ram type blowout preventer 10. Actuation means 22 is operated to move variable bore ram packer 30 to the sealing position shown in FIG. 5. In this position, top plates 44 and bottom plates 46, along with packer member 32, have move inward. Top plates 44 and bottom plates 46 have moved spirally inward like the iris of a camera shutter to form a continuous band of steel around tubular member 66. As top plates 44 and 46 move inwardly in an irising motion, guide lips 58 and guide shoulders 60 of adjacent top plates, slide over one another to insure proper movement of the top plates 44 as a unit. Similarly, guide lips 62 and guide shoulders 64 formed on bottom plates 46 also slide over one another to insure proper movement. Spacer pins 48, connecting each pair of top plates 44 and bottom plates 46, insure the upper and lower sections move in concert with packer member 32 as it forced outwardly against tubular member 66. The relatively small cross section and round shape of spacer pins 48 also serves to reduce the stress in the elastomeric material or rubber of packer member 32 as it is forced radially inwardly to seal against tubular member 66. This is particularly useful when operating the rams in a cold weather environment in which the rubber of packer member 32 is most viscous and resistant to movement. FIG. 6 is a sectional view of FIG. 5 showing how top plates 44 and bottom plates 46 move in concert to seal against straight diameter tubular member 66.

Figure 7:
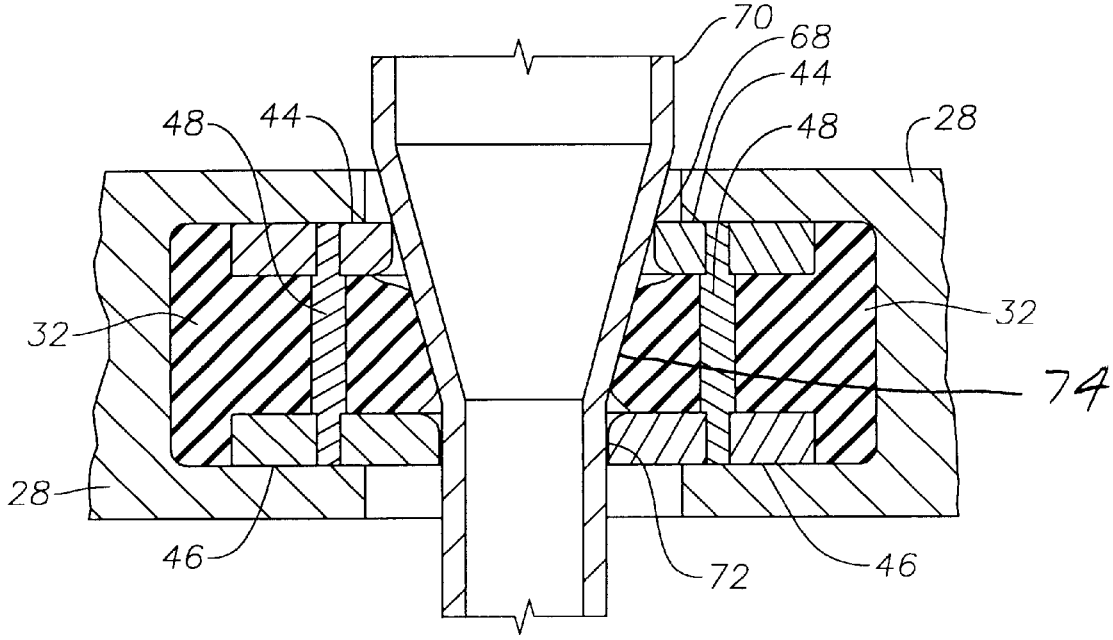
FIG. 7 is a sectional view of the variable bore ram packer in its closed and sealing position around a tapered diameter such as a tool joint.
Figure 8:
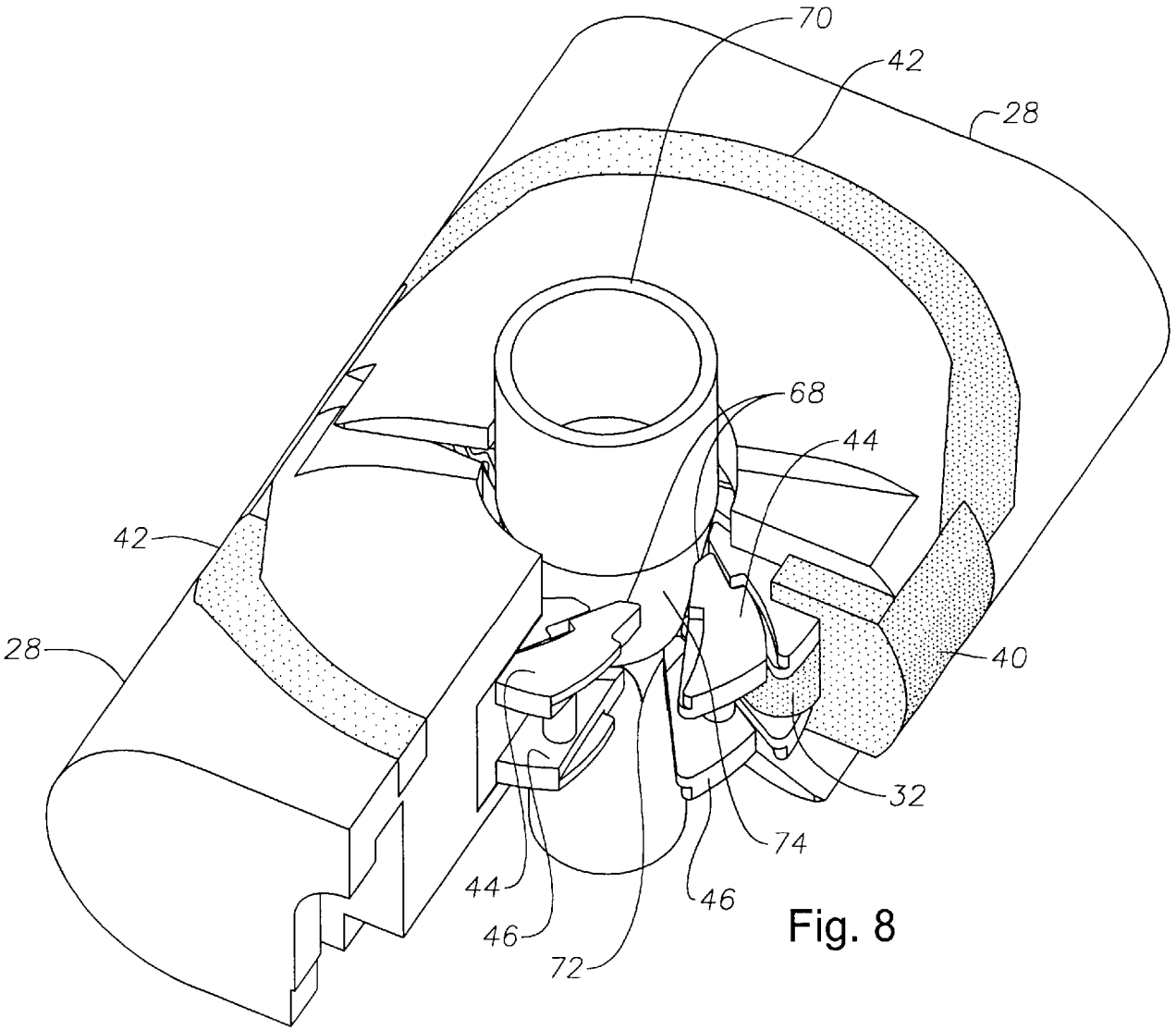
FIG. 8 is a perspective view of the variable bore ram packer in its closed and sealing position around a tapered diameter such as a tool joint.

As best seen in FIG. 7, the unique ability of variable bore ram packer 30 to seal on a tapered diameter tubular member such as a tool joint is shown. As the rams are closed, upper plates 44 move in an irising motion to seat against the larger diameter at the upper portion 68 of tool joint 70. Simultaneously, lower plates 46 move in an irising motion to seat against the smaller diameter at the lower portion 72 of tool joint 70. The elastomeric material or rubber of packer member 32 is forced radially inwardly to seal against the tapered shoulder 74 of tool joint 70. FIG. 8 is a perspective view of the sealing action of FIG. 7. It shows the relative independent rotational movement that occurs between top plates 44 and bottom plates 46, thus allowing them to move independently on spacer pins 46 in an irising motion to seat against the tapered shoulder 74 of tool joint 70 to prevent extrusion of elastomeric material or rubber of packer member 32 as it seals against tool joint 70.

Figure 9:
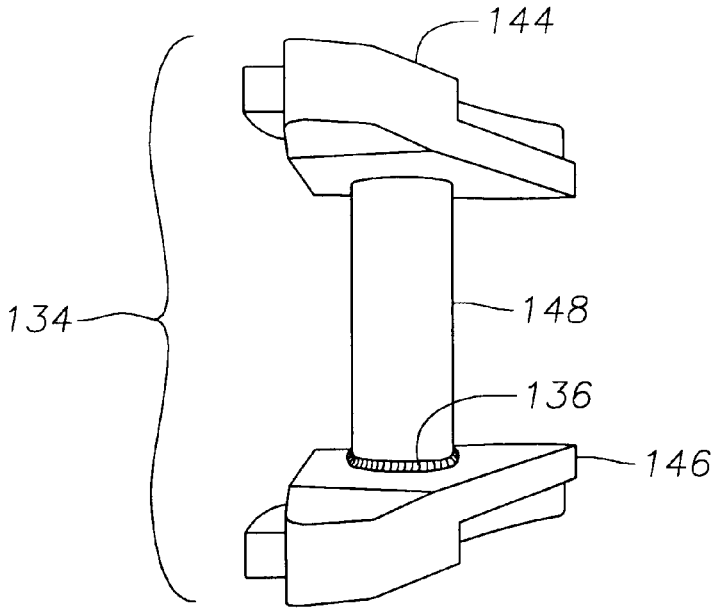
FIG. 9 is a perspective view of the pillar insert for the variable bore ram packer with the spacer pin and bottom plate welded together.
Figure 10:
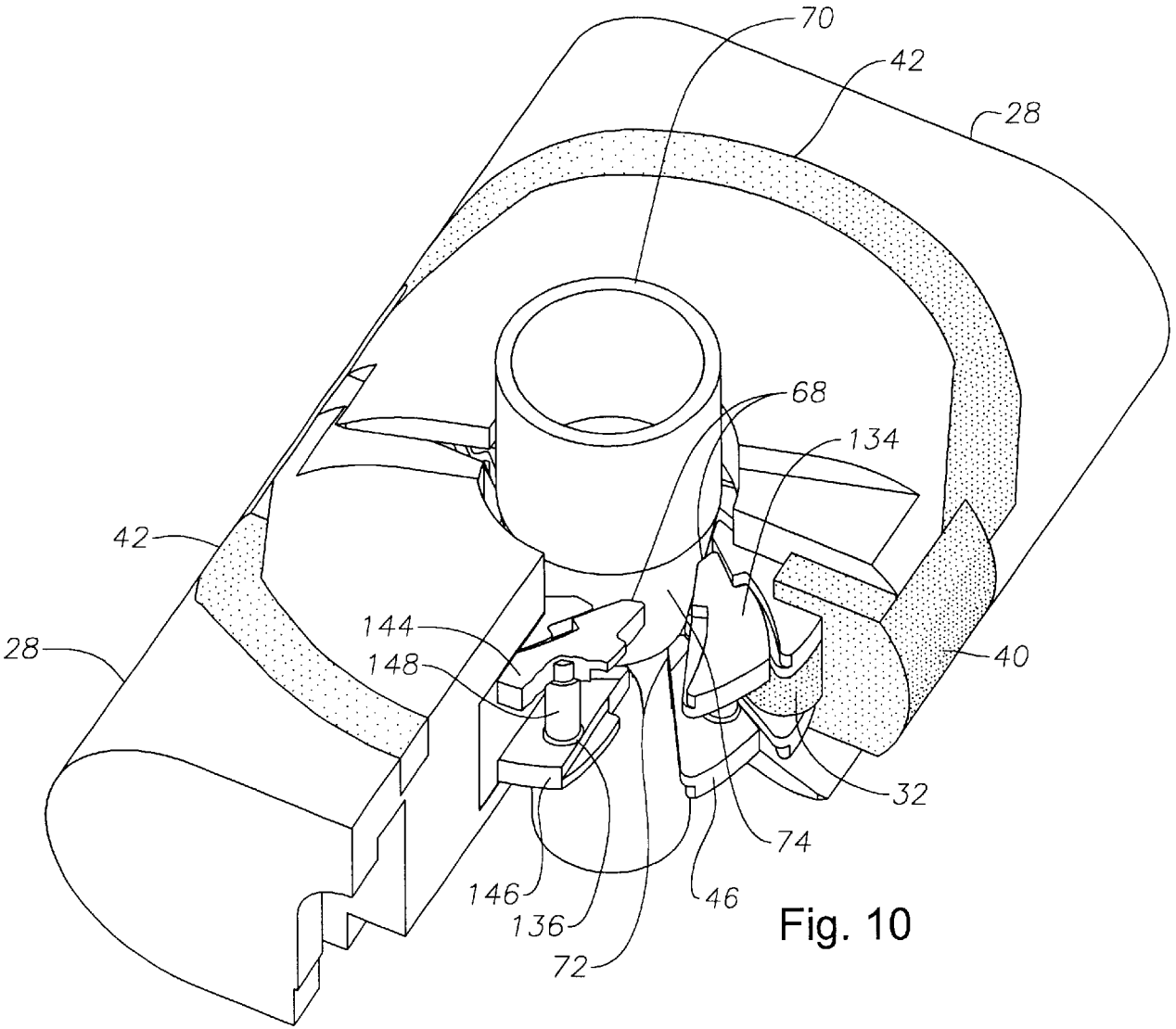
FIG. 10 is a perspective view of the variable bore ram packer in its closed and sealing position around a tapered diameter such as a tool joint with the pillar insert of FIG. 9.

An alternate embodiment is shown in FIGS. 9 and 10. Those items having the same function as in the preferred embodiment have retained their original numeric designation. As best seen in FIG. 9, pillar inserts 134 include top plate 144, bottom plate 146 and spacer pin 148. Pillar insert 134 is identical with pillar insert 34 of the preferred embodiment except that bottom plate 146 and spacer pin 148 are affixed to one another by fillet weld 136. With this configuration, top plate 144 can still rotate with independent rotational movement with respect to spacer pin 148 and bottom plate 146 which move as a unit. Although the connection between bottom plate 146 and spacer pin 148 is shown to be welded, any suitable means for preventing such rotation as threading bottom plate 146 and spacer pin 148 together or forming bottom plate 146 and spacer pin 148 as a single unit by machining or casting is envisioned and within the scope of the current invention. In all other respects, pillar insert 134 is identical with pillar insert 34 including guide lip 58 and guide shoulder 60 formed on top plate 144 and guide lip 62 and guide shoulder 64 formed on bottom plate 146.

Referring now to the perspective view of FIG. 10, the unique ability of variable bore ram packer 30 to seal on a tapered diameter tubular member such as a tool joint is preserved. As the rams are closed, upper plates 144 move in an irising motion to seat against the larger diameter at the upper portion 68 of tool joint 70 by rotating on spacer pin 148. Simultaneously, lower plates 146 and spacer pins 148 move in an irising motion to seat against the smaller diameter at the lower portion 72 of tool joint 70 as in the preferred embodiment. The elastomeric material or rubber of packer member 32 is forced radially inwardly to seal against the tapered shoulder 74 of tool joint 70. The relative independent rotational movement that occurs between top plates 144 and bottom plates 146 allows them to move independently to seat against the tapered shoulder 74 of tool joint 70 to prevent extrusion of elastomeric material or rubber of packer member 32 as it seals against tool joint 70.

Figure 11:
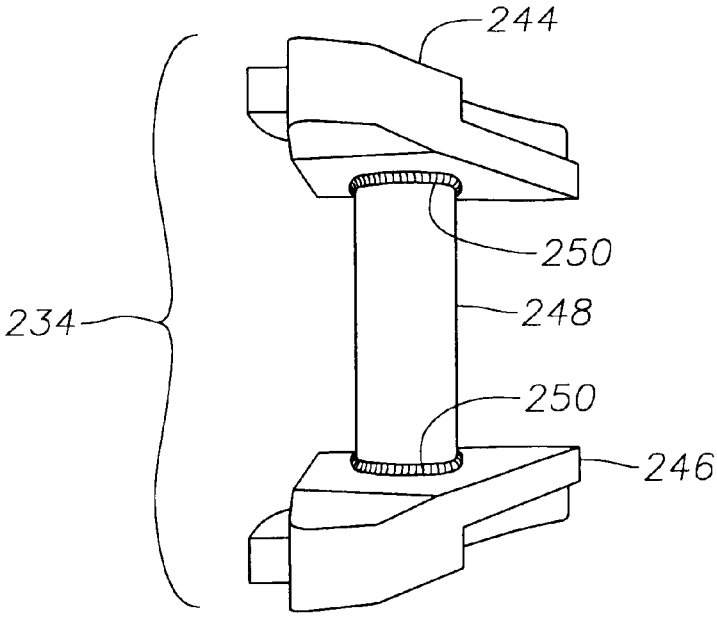
FIG. 11 is a perspective view of the pillar insert for the variable bore ram packer with the spacer pin welded to the top plate and bottom plate.
Figure 12:
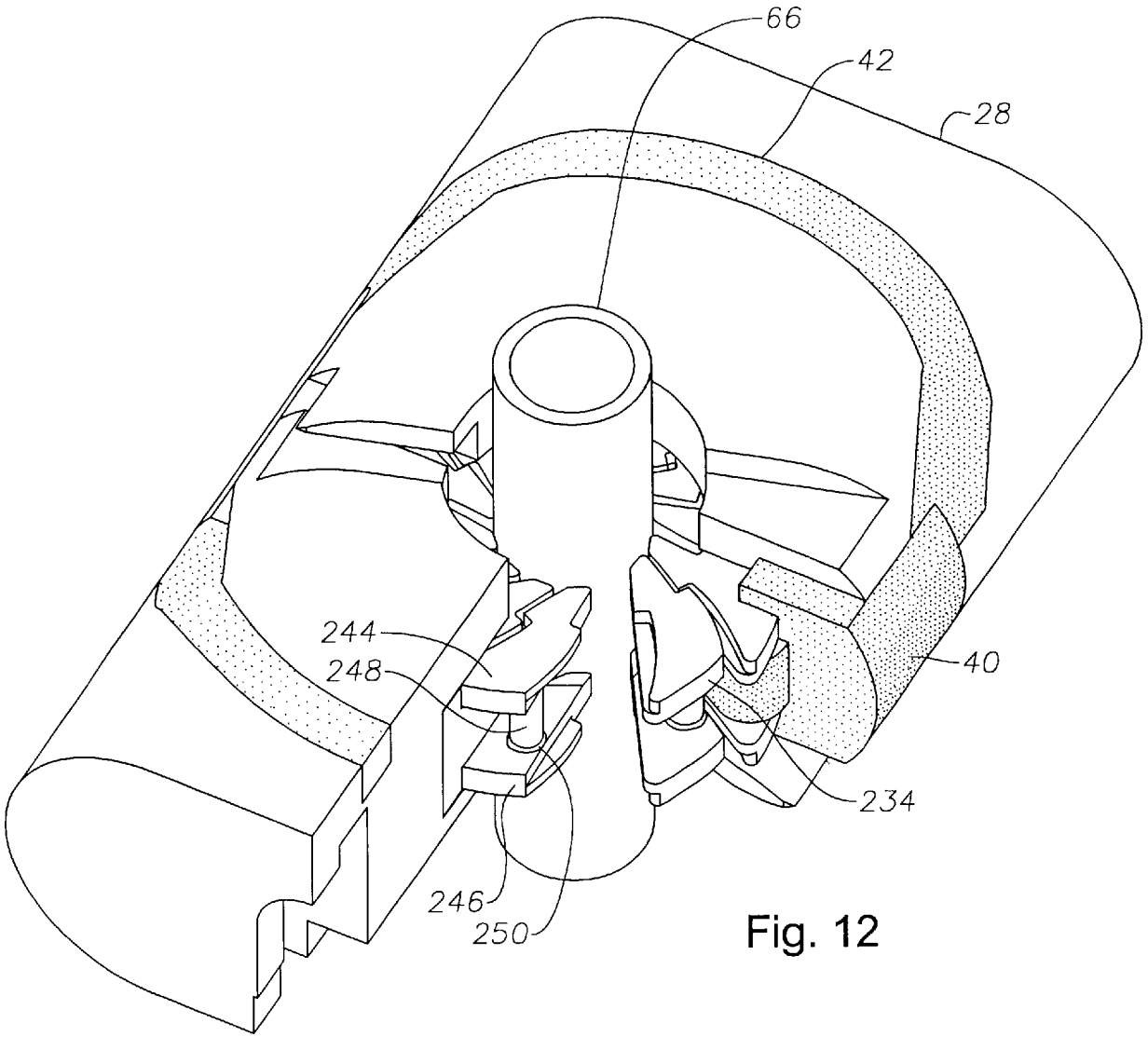
FIG. 12 is a perspective view of the variable bore ram packer in its closed and sealing position around a straight diameter tubular member with the pillar insert of FIG. 11.

A second alternate embodiment is shown in FIGS. 11 and 12. Those items having the same function as in the preferred embodiment have retained their original numeric designation. As best seen in FIG. 11, pillar inserts 234 include top plate 244, bottom plate 246 and spacer pin 248. Pillar insert 234 is identical with pillar insert 34 of the preferred embodiment except that top plate 244, bottom plate 246 and spacer pin 248 are affixed together as one unit by fillet welds 250. With this configuration, top plate 244 and bottom plate 246 move as a unit. Although the connection between top plate 244, bottom plate 246 and spacer pin 248 is shown to be welded, any suitable means for preventing such rotation as threading top plate 244, bottom plate 246 and spacer pin 248 together or forming top plate 244, bottom plate 246 and spacer pin 250 as a single unit by machining or casting is envisioned and within the scope of the current invention. As in the previous embodiments, pillar inserts 234 including guide lip 58 and guide shoulder 60 formed on top plate 244 and guide lip 62 and guide shoulder 64 formed on bottom plate 246.

Referring now to the perspective view of FIG. 12, the ability of variable bore ram packer 30 to seal on a straight diameter tubular member is shown. As the rams are closed, upper plates 244, lower plates 246 and spacer pins 248 move as a single unit in an irising motion to seat against the straight diameter tubular member 66. The elastomeric material or rubber of packer member 32 is forced radially inwardly to seal against the straight diameter of tubular member 66. Top plates 244 and bottom plates 246 act together to seat against the straight diameter of tubular member 66 to prevent extrusion of elastomeric material or rubber of packer member 32 as it seals against tubular member 66.

The construction of my improved variable bore ram packer will be readily understood from the foregoing description and it will be seen that we have provided an improved variable bore ram packer to allow sealing over a tapered diameter tubular member while reducing stresses in the elastomeric rubber compound. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims

What is claimed is:

1. A variable bore packer used in a ram-type blowout preventer for oil and gas drilling operations, comprising:

a packer member molded of elastomeric material having a central semi-circular opening sized to fit closely about a tubular member;

a plurality of pillar inserts molded within said elastomeric material around said central semi-circular opening;

said packer member and said plurality of pillar inserts being molded into a unitary structure allowing said plurality of pillar inserts to move and seat against different diameter tubular members to prevent extrusion of said elastomeric material between said pillar inserts and the tubular member;

said unitary structure is molded to form a pair of side packers integral with said packer member;

said pillar inserts include a top plate, a bottom plate and a spacer pin positioned therebetween; and, said spacer pin allows independent rotational movement between said spacer pin and at least one of said top plate and said bottom plate.

2. A variable bore packer used in a ram-type blowout preventer for oil and gas drilling operations according to claim 1, wherein:

each of said top and bottom plates includes a guide lip and a guide shoulder; and, said guide lips and said guide shoulders of adjacent top plates and said guide lips and said guide shoulders of adjacent bottom plates coact to provide an irising motion to said top and bottom plates as said top and bottom plates move and seat against different diameter tubular members.

3. A variable bore packer used in a ram-type blowout preventer for oil and gas drilling operations according to claim 2, wherein:

said irising motion of said top plates and said irising motion of said bottom plates are independent.

4. A variable bore packer used in a ram-type blowout preventer for oil and gas drilling operations according to claim 3, including:

a plurality of packer pins molded in said packer member to connect said variable bore packer to a ram-type blowout preventer.

5. A variable bore packer used in a ram-type blowout preventer for oil and gas drilling operations according to claim 1, wherein:

said spacer pin is affixed to said bottom plate to prevent rotational movement between said spacer pin and said bottom plate.

6. A variable bore packer used in a ram-type blowout preventer for oil and gas drill operations according to claim 5, wherein:

each of said top and bottom plates includes a guide lip and a guide shoulder; and, said guide lips and said guide shoulders of adjacent top plates and said guide lips and said guide shoulders of adjacent bottom plates coact to provide an irising motion to said top and bottom plates as said top and bottom plates move and seat against different diameter tubular members.

7. A variable bore packer used in a ram-type blowout preventer for oil and gas drilling operations according to claim 6, including:

a plurality of packer pins molded in said packer member to connect said variable bore packer to a ram-type blowout preventer.

8. A variable bore packer used in a ram-type blowout preventer for oil and gas drilling operations according to claim 1, wherein:

said spacer pin is affixed to said top plate to prevent rotational movement between said spacer pin and said top plate.

9. A variable bore packer used in a ram-type blowout preventer for oil and gas drilling operations according to claim 8, wherein:

each of said top and bottom plates includes a guide lip and a guide shoulder; and, said guide lips and said guide shoulders of adjacent top plates and said guide lips and said guide shoulders of adjacent bottom plates coact to provide an irising motion to said top and bottom plates as said top and bottom plates move and seat against different diameter tubular members.

10. A variable bore packer used in a ram-type blowout preventer for oil and gas drilling operations according to claim 9, including:

a plurality of packer pins molded in said packer member to connect said variable bore packer to a ram-type blowout preventer.

11. A ram-type blowout preventer used in oil and gas drilling operations having a variable bore ram assembly, comprising:

a body with a vertical bore;

a pair of opposing bonnet assemblies laterally disposed in said body;

a pair of opposing variable bore rams laterally moveable within said bonnet assemblies;

said variable bore rams providing a seal around a tapered diameter tubular member disposed within said vertical bore upon closing of said variable bore rams;

said pair of variable bore rams each includes a ram body, a top seal and a packer member;

said packer member molded of elastomeric material having a central semi-circular opening sized to fit closely about a tubular member;

said packer member includes a plurality of pillar inserts molded within said elastomeric material around said central semi-circular opening;

said packer member and said plurality of pillar inserts being molded into a unitary structure allowing said plurality of pillar inserts to move and seat against different diameter tubular members to prevent extrusion of said elastomeric material between said pillar inserts and the tubular member;

said unitary structure is molded to form a pair of side packer seals integral with said packer member;

said pillar inserts include a top plate, a bottom plate and a spacer pin positioned therebetween; and, said spacer pin allows independent rotational movement between said spacer pin and at least one of said top plate and said bottom plate.

12. A ram-type blowout preventer used in oil and gas drilling operations having a variable bore ram assembly according to claim 11, wherein:

each of said top and bottom plates includes a guide lip and a guide shoulder; and, said guide lips and said guide shoulders of adjacent top plates and said guide lips and said guide shoulders of adjacent bottom plates coact to provide an irising motion to said top and bottom plates as said top and bottom plates move and seat against different diameter tubular members.

13. A ram-type blowout preventer used in oil and gas drilling operations having a variable bore ram assembly according to claim 12, wherein:

said irising motion of said top plates and said irising motion of said bottom plates are independent.

14. A ram-type blowout preventer used in oil and gas drilling operations having a variable bore ram assembly according to claim 13, including:

a plurality of packer pins molded in said packer member to connect said variable bore packer to a ram-type blowout preventer.

15. A ram-type blowout preventer used in oil and gas drilling operations having a variable bore ram assembly according to claim 11 wherein:

said spacer pin is affixed to said bottom plate to prevent rotational movement between said spacer pin and said bottom plate.

16. A ram-type blowout preventer used in oil and gas drilling operations having a variable bore ram assembly according to claim 15, wherein:

each of said top and bottom plates includes a guide lip and a guide shoulder; and, said guide lips and said guide shoulders of adjacent top plates and said guide lips and said guide shoulders of adjacent bottom plates coact to provide an irising motion to said top and bottom plates as said top and bottom plates move and seat against different diameter tubular members.

17. A ram-type blowout preventer used in oil and gas drilling operations having a variable bore ram assembly according to claim 16, including:

a plurality of packer pins molded in said packer member to connect said variable bore packer to a ram-type blowout preventer.

18. A ram-type blowout preventer used in oil and gas drilling operations having a variable bore ram assembly according to claim 11, wherein:

said spacer pin is affixed to said top plate to prevent rotational movement between said spacer pin and said top plate.

19. A ram-type blowout preventer used in oil and gas drilling operations having a variable bore ram assembly according to claim 18, wherein:

each of said top and bottom plates includes a guide lip and a guide shoulder; and, said guide lips and said guide shoulders of adjacent top plates and said guide lips and said guide shoulders of adjacent bottom plates coact to provide an irising motion to said top and bottom plates as said top and bottom plates move and seat against different diameter tubular members.

20. A ram-type blowout preventer used in oil and gas drilling operations having a variable bore ram assembly according to claim 19, including:

a plurality of packer pins molded in said packer member to connect said variable bore packer to a ram-type blowout preventer.

* * * * *